United States Patent [19]

Kurtz

[11] 4,143,962

[45] Mar. 13, 1979

[54] ELECTROGRAPHIC IMAGING APPARATUS AND METHOD

[75] Inventor: Clark N. Kurtz, Rochester, N.Y.

[73] Assignee: Eastman Kodak Company, Rochester, N.Y.

[21] Appl. No.: 805,216

[22] Filed: Jun. 9, 1977

[51] Int. Cl.[2] ..... G03G 15/10

[52] U.S. Cl. ..... 355/10

[58] Field of Search ..... 355/3 P, 10, 14; 96/1 LY; 118/DIG. 23, 659

[56] References Cited

U.S. PATENT DOCUMENTS

| | | | |
|---|---|---|---|
| 3,779,166 | 12/1973 | Pressman | 355/3 P X |
| 4,045,217 | 8/1977 | Fujimura | 355/10 X |

*Primary Examiner*—R. N. Envall, Jr.
*Attorney, Agent, or Firm*—John D. Husser

[57] ABSTRACT

Apparatus and method for imagewise controlling the flow of ions from a source toward an electrostatic image-bearing member utilize a predeterminedly electrically-biased slit means located between the ion source and the member. A portion of the slit means is maintained at a potential intermediate the image and background portions of the electrostatic image and so that ion flow toward the member is controlled in accordance with the image thereon. A substantially neutrally-charged mist is introduced between the slit means and the image-bearing member and charged and attracted to the member in accordance with the image.

11 Claims, 4 Drawing Figures

ELECTROGRAPHIC IMAGING APPARATUS AND METHOD

BACKGROUND OF THE INVENTION

1. Field of the Invention

The present invention relates to electrographic imaging and more particularly to improved apparatus and techniques for use in the development of electrographic images.

2. Brief Description of the Prior Art

At present the most common commercial technique for developing latent electrostatic images on dielectric supports is by contacting such images with triboelectrically-charged marking particles, in mixture with a particulate or liquid carrier medium. However, since the early stages in evolution of electrographic copying and printing techniques, it has been recognized that certain advantages pertain to development of latent electrographic images with small, airborne marking particles, e.g., in "liquid mist" or "powder cloud" form (hereinafter collectively referred to as "mists"). A primary advantage envisioned for mist development has been the achievement of higher resolution development and thus better quality in fine line detail and half-tone and continuous tone reproductions. A minimizing of wear on image elements was another advantage envisioned.

Early systems seeking to obtain such advantages introduced a mist of electrostatically charged marking particles between an image member (bearing an electrostatic image to be developed) and a development electrode that was spaced closely to the image bearing surface and connected to a source of potential which created an electrical field urging the charged particles toward the image. However, commercialization of such systems has been hampered by the tendency of precharged marking particles to mutually repel one another, causing great difficulty in production and transport of a uniformly charged and concentrated mist.

More recently electrographic imaging and development systems have been disclosed which utilize a mist of substantially-neutrally-charged marking particles, introduced between a uniformly-electrically-biased copy sheet and an apertured or grid array. Such arrays have been electrically-biased according to the image pattern to be reproduced and used to modulate the passage of an ion stream directed toward the receiver. The ions which pass through the modulator charge marking particles in their path, causing the particles to be attracted to and deposit on the receiver (see, e.g., U.S. Pat. No. 3,779,166). Although such neutral charge mist development systems obviate substantially the problems presented in use of precharged marking particles, they introduce certain other disadvantages and limitations. Specifically, the distance between the modulator and the receiver causes a loss of image sharpness. Also, the image resolution obtainable is limited by the opening size and spacings in the modulator, so that high resolution modulators are costly and highly susceptible to damage and clogging. Further, any continuous system of this type would require synchronization of the movement of the mist with respect to the receiver.

This invention is concerned with a new type of electrographic development which obtains the advantages of mist development yet avoids the disadvantages and limitations connected with prior art approaches.

SUMMARY OF THE INVENTION

Thus, it is an object of the present invention to provide new and improved apparatus and techniques for use in development in electrographic imaging.

A further object of the present invention is to facilitate high resolution development of electrographic images.

Another object of the present invention is to facilitate mist development of electrographic images without precharging the marking particles and without the use of an image modulating aperture or grid array.

Yet another object of the present invention is to provide improved technique and apparatus for mist developing a moving electrographic image.

The foregoing and other objects and advantages are obtained in accordance with the present invention by providing, adjacent an image element having an electrical pattern to be developed, a mist layer comprising substantially-neutrally-charged developing particles and a predetermindedly-electrically-biased, ion control member. Upon directing a stream of ions toward the mist, via the control member, the imagewise-varying electrical propulsion field across the mist, i.e., between the image element and the control member, effects controlled charging of the mist particles and controlled deposition of the particles on the image element. Such deposition is precisely in accordance with the outline of electrical pattern on the image element and the proportion to the relative magnitude of the pattern portions.

BRIEF DESCRIPTION OF THE DRAWINGS

The invention is hereinafter described in connection with the attached drawings form a part hereof and in which.

DETAILED DESCRIPTION OF THE PREFERRED EMBODIMENTS

Figure 1:
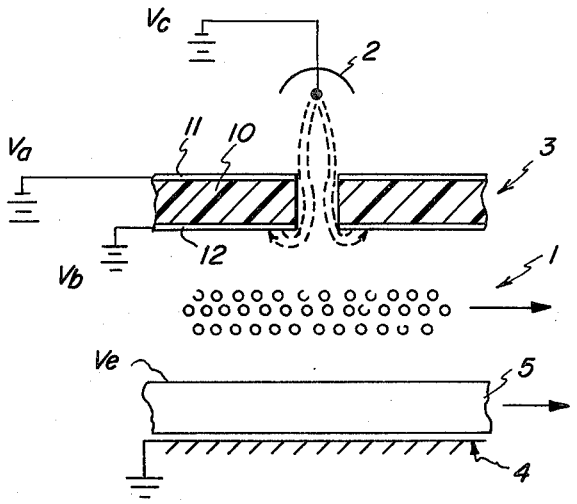
FIGS. 1 and 2 are side elevational views illustrating schematically the construction and operation of one embodiment of the present invention.
Figure 2:
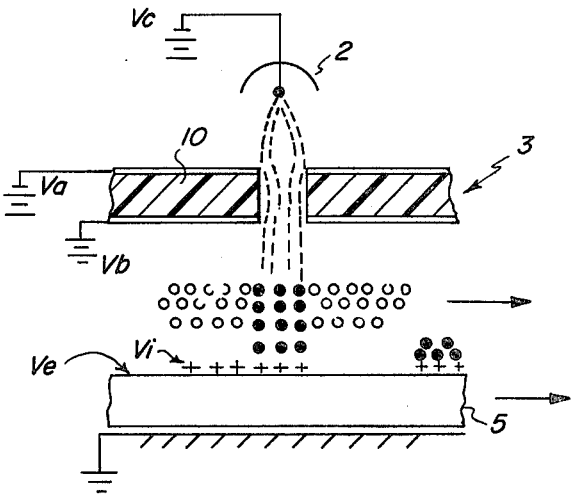

Referring to FIGS. 1 and 2, there is illustrated one construction and mode for implementing development in accordance with the present invention. In those Figures it can be seen that at a development station 1, there is provided ion generating means, viz. a corona device 2 for directing a stream of ions toward an ion control means, viz, plate 3 having a slit therein, which, in turn, is uniformly spaced from a support means, viz. platen 4. During operation an image element 5 to be developed, is moved through station 1, across platen 4; and a mist of developer particles is introduced to pass between plate 3 and the portions of element 5 moving successively therepast.

The slit in plate 3 should extend substantially completely across an element to be developed and can desirably be oriented generally transversely to the direction of feed of element 5 (i.e., normal to the paper as seen in FIGS. 1 and 2). FIGS. 1 and 2 also illustrate a particularly useful cross-sectional configuration of ion control means for use in the present invention. Specifically plate 3 comprises a laminate structure in which a dielectric layer 10 is sandwiched between a top electrically-conductive layer 11 and a bottom electrically-conductive layer 12. The width of the slit desirably can be in the range of about 5 to 50 mils. Also it is desirable that the width to thickness ratio of the slit be less than about 2 to obtain a good fringe control field for purposes which will be described below.

The corona device 2 also should extend generally transversely across to the path of feed of element 5 and in alignment with the slit in plate 3. The corona device 2 can be of any conventional type capable of directing a stream of ions of selected polarity toward the slit. An exemplary slit to corona spacing, e.g., is in the order of 0.1 inch.

The support surface 4 can be electrically-conductive or otherwise capable of providing a reference potential (shown as ground in FIGS. 1 and 2) and is orientated generally parallel to plate 3 to provide equidistance between the portions of a supported image element being developed and plate 3. The space between the support member 4 and the bottom conductive layer 12 of the plate 3 desirably is as small as will permit laminar flow of mist between the element 5 and the plate 3 at operative speeds utilized. An exemplary spacing is about 0.1–0.2 inches at an operative element speed of 1–10 inches per second.

The developing particle mist is generated in a manner known in the art, e.g., see U.S. Pat. No. 3,779,166, and comprises a plurality of substantially neutrally-charged particles. The mist particles should be capable of receiving a charge from an ion stream and of facilitating visualization of a latent electrographic image on the image member. Exemplary ink mist particles useful in accordance with the present invention are mist droplets, 5–20 microns in diameter, which are inks composed of Plasto Red Brown NR or Nezapon Orange G in 15% solution of Acetophenone.

The mist is introduced in a stream moving across the developing zone, preferably in the same direction as the movement of element 5; however, there can exist relative movement between the mist and the image element. It is also desirable that confining layers of air be flowed on both sides of the mist layer, i.e., between the mist and the plate 3 and between the mist and the image element 5. This procedure and means for accomplishing it are conventional and disclosed in more detail in U.S. Pat. No. 3,779,166.

Still with reference to FIGS. 1 and 2, it is to be noted that the conductive layers 11 and 12 of plate 3 are each held at a particular potential level V*a* and V*b*, respectively. The values of these potentials are selected in accordance with this illustrative embodiment of the invention for two purposes. First, the potential levels are selected so that the potential between the conductive layers, i.e., V*ab*, creates electrical fringe fields across the slit that will enhance the flow of ions therethrough. For example, assuming negative ions are generated by voltage V*c* applied to corona device 2, the voltages V*a* and V*b* should be such that V*b* is positive relative to V*a* to provide such an enhancing fringe field. Exemplary values are $Va = -140$ volts and $Vb = +100$ volts.

The second criteria which should be achieved in selection of the system voltages is that the voltage of the bottom conductive layer should create, in cooperation with portions of the charge-bearing image element to be developed, a net propulsion field that is directed toward the portions of the image member to be developed. For example, in the above described system, the bottom layer voltage, $Vb = +100$ volts, would be suitable to cause the desired propulsion field toward an image member in which the portions to be developed bore an electrostatic charge of, e.g., +400 volts and non-image portions were less than +100 volts. It should be noted that in some image members useful with the present invention, e.g., a photoconductor which is uniformly-electrostatically-charged and discharged by a light pattern prior to entering the development station, a background voltage exists on portions which should not be developed. It is highly desirable in such instances that the voltage V*b* be at a level which will prevent ions from moving toward such background portions, i.e., form in cooperation with the background portions a propulsion field toward the layer 12 instead of toward the image element. In the exemplary embodiment described above, the voltage $Vb = +100$ volts would perform acceptably with a background voltage, e.g., +50 volts.

In operation, assuming the voltage polarities and magnitudes described above, it will be seen that flow of the ion stream from source 2 is enhanced through the slit of plate 3 by the fringe fields thereacross, see FIGS. 1 and 2. When an exposure discharged or uncharged portion Ve of image element 5 (or portion having only a background charge, e.g., +50 volts) is moved past the development station, the propulsion field directs the ion stream toward the bottom conductive layer 12 of the plate 3, i.e., the $Vb = +100$ volts, $Ve = +50$ volts field causes the negative ions to move toward plate 12 (see FIG. 1). However, when more highly charged image portions of the element 5 move past the developing zone, the propulsion field changes, i.e., $Vb = +100$, $Vi = +400$ and the negative ions are directed toward the image element as shown in FIG. 2. Thus the ion control member, in cooperation with the electrostatic image provides means for controlling the flow of ions to the image element in accordance with the charge pattern thereon. During movement toward the image element, the ions interact with mist particles causing the particles to acquire a negative charge (indicated in solid in FIG. 2). The mist particles, thusly charged, are attracted to the positively charged image areas V*i* on the image member.

Considering the foregoing, several points are worthy of reflection. First, once the "on propulsion field," created by an image portion of element 5 and the bottom layer of plate 3 has effected charging of intermediate mist particles as described above, the movement of the charge particles toward the image member can continue at points downstream from the slit. Second, it is to be noted that selected "off-on" control of a plurality of discrete zones along the length of the slit is not required; therefore resolution is not necessarily dependent on manufacturability limitations relating to grids or aperture arrays. Third, although ion control member, plate 3, is spaced from the image element by the distance required for proper mist passage, the present invention minimizes adverse resolution effects of such spacing because the electrographic image itself provides a focusing force on the charged particles moving theretoward. In view of the second and third points mentioned above, it will be appreciated that the criticality of synchronization between web and mist movement is lessened substantially by the present invention. Finally, it will be appreciated that deposition of developer particles will be in proportion to the image charge present so that continuous tone variations are obtainable.

It is to be understood that foregoing embodiment is not limitative and that various modifications and alternative forms are possible in accordance with the present invention. In one such modification, ion polarity and control voltages can be varied to obtain reverse development of electrographic images. For example, assume an electrographic image of the same type described above, comprised of image portions $Vi = +400$ volts and background portions $Ve = +50$ volts. The apparatus described with respect to FIGS. 1 and 2 could be modified to provide reverse development of such an image by changing the corona device to provide positive polarity ions, and changing the ion control plate voltages to $Va = +500$ volts and $Vb = +300$ volts. In this mode, positive ions would pass through the slit and would be directed to the plate in response to image portions ($Vi = +400$ volts) passing under the slit. However, the ions would be directed to the image member in response to the passing of exposed portions ($Ve = +50$ volts) under the slit.

It will of course be appreciated that the present invention can be utilized with a variety of electrographic image elements. For example, conventional photoconductors can be charged and exposed, dielectric members can be imagewise electrostatically charged by apparatus such as electrostatic stylus recorders, charge image transfer devices or other image pattern charging devices.

Although it is preferred in accordance with the present invention to use an elongated slit rather than grids or apertures, the present invention could be implemented using grids or apertures instead of such a slit, such openings being generically referred to herein as slit means. It would not be necessary to selectively address the individual openings; resolution might nevertheless be sacrificed to some extent. However other advantageous aspects of the invention would be present. Also, rather than using a laminate structure such as shown in FIGS. 1 and 2 for the ion control means, the control plate could comprise a single conductive layer. However, in using the single layer, the desirable effect of an enhancing fringe field would be sacrificed.

In further extensions of the invention, a plurality of developing stations of the type shown in FIGS. 1 and 2 can be provided in sequence along the path of movement of an electrographic image member. In certain embodiments this may permit more complete particle deposition, up to the point where the charge on the member is equalized; and higher image density development could thus be facilitated. A similar enhancement of image density can be achieved to some extent by extending the propulsion field downstream, along the path of movement of the image member. This can be implemented by extending the conductive layer, thus allowing particles charged during passage under the slit to continue their movement toward the image element at a downstream location.

Figure 3:
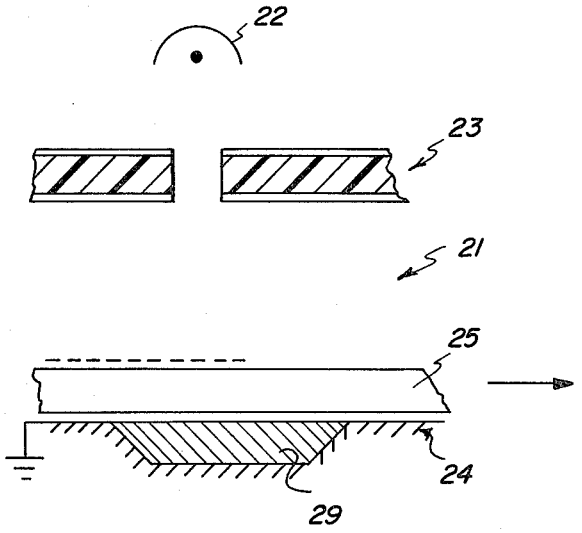
FIG. 3 is a side elevational view, similar to FIG. 1, but illustrating schematically the construction of a modified embodiment of the present invention.

Referring now to FIG. 3 there is shown another modification which can be utilized in accordance with the present invention to enhance the propulsion field effective between the portion of an image member 25, passing a developing station 21 and the ion control plate 23. The slitted member 23 and corona device 22 can be constructed and electrically-biased as described with respect to FIGS. 1 and 2. However, the support plate 24 is provided with a dielectric insert 29 in the surface thereof opposite the slit. Thus when an image member 25 is a dielectric or photoconductive web or sheet, bearing an electrostatic image, the dielectric insert 29 decreases the internal field of the image member, i.e., between the upper and lower surfaces of the image member; and the propulsion field between the upper surface of member 25 and the lower layer of plate 23 is commensurately increased. For example it was found that when an epoxy insert of dielectric constant $\epsilon p \approx 4$ and thickness 0.021" was imbedded in the grounded support 24 and a dielectric web ($\epsilon p = 3.5$ and thickness 0.0008") bearing an image charge of $-100$ volts was moved over the platen, the surface voltage increased to $-2000$ volts. Commensurate changes are of course made in the magnitudes of the voltages on control plate 23 to retain the general voltage differential relation described with respect to FIGS. 1 and 2.

Figure 4:
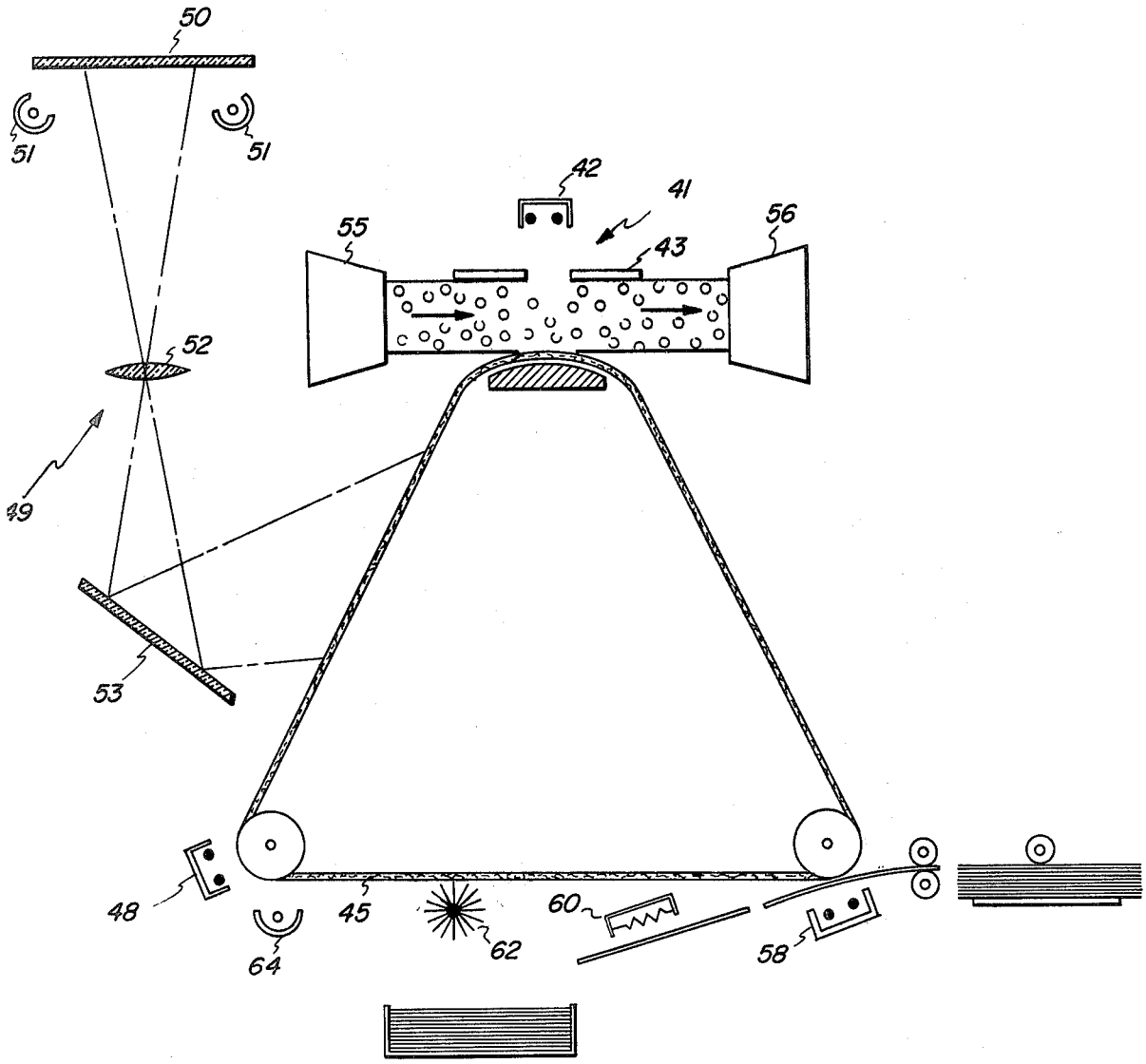
FIG. 4 is a schematic illustrtion of one embodiment of continuous electrophotographic apparatus embodying the present invention.

Referring now to FIG. 4, one device for implementation of the present invention in the continuous mode of operation is disclosed. As can be seen in that Figure, a photoconductive web 45 (comprising a photoconductive insulator layer overlying a conductive layer carried on a support) is moved around an endless operative path. Image sectors of the web, in operative sequence, pass a conventional primary charging station 48 and exposure station 49 whereby an electrostatic image pattern is formed. As shown exposure is of illuminated original 50, on the fly, via flash lamps 51, lens 52 and mirror 53. Exposed image sectors, bearing the latent electrostatic images then pass to developing station 41, where a developing mist of the type described above is moved thereover, from a mist generator 55 to a mist recovery device 56.

The slitted ion control plate 43 and corona device 42 are constructed and function as described above to effect development of the electrostatic image. Potential sources for control plate 43 are not shown but can be selected in accordance with the foregoing teachings. After development, the image is transferred, e.g., to plain paper by conventional corona transfer device 58. The image on the paper can be dried or otherwise fixed by heater 60 and passes to an output bin. The web sector then continues past a cleaning station 62 where residual developer is removed, an erase station 64 where the photoconductor is regenerated and is ready for recycling. The elements of the above-described system, with exception of the development device are conventional; however, it will be appreciated from the foregoing that the present invention is entirely compatible with such continuous apparatus.

The invention has been described in detail with particular reference to certain preferred embodiments thereof, but it will be understood that variations and modifications can be effected within the spirit and scope of the invention.

I claim:

1. In electrographic apparatus of the type utilizing an electrostatic-charge-retentive member and including means for forming an electrostatic pattern having image and background portions of different charge level on such member and means for moving such member along an operative path, the improvement comprising:

(a) means for producing a stream of ions directed generally transversely across said path;

(b) ion control means located intermediate said ion producing means and said path and defining an elongated slit means transverse to said path, in alignment with said ion stream and spaced generally uniformly from said path;

(c) means for electrically biasing at least a portion of said control means facing said path to a potential level intermediate the image and background charge portions of such pattern; and (d) means for directing substantially neutrally-charged mist particles through the space between said control means and said path whereby the passage of ions through said slit is modulated according to said charge pattern and said mist particles are thereby charged and attracted to said member in accordance with said pattern.

2. The invention defined in claim 1 wherein said control means includes means for electrically enhancing ion flow through said slit means.

3. The invention defined in claim 1 wherein said control means comprises at least two electrically-conductive plates separated by an electrically-insulative layer.

4. The invention defined in claim 1 further including an electrically-conductive platen on the opposite side of said operative path from said control means.

5. The invention defined in claim 4 wherein said platen includes a dielectric portion aligned with said slit means.

6. A method of electrographic imaging comprising the steps of:

(a) forming an electrostatic image on a charge-retentive member and moving the member along an operative path;

(b) directing a stream of ions toward said path;

(c) controlling the flow of ions from said stream to said member in accordance with the electrostatic image thereon; and (d) introducing substantially neutrally-charged mist particles over said member.

7. The invention defined in claim 6 wherein said controlling step includes creating a first electrical control field enhancing movement of ions from said stream toward said path and creating a second electrical control field which cooperates with the electrical fields of electrostatic image to selectively attract or repel ions from movement toward said member.

8. In electrographic apparatus of the type utilizing a charge-retaining member and having means for forming an electrostatic image pattern on such member, the improvement comprising:

(a) charging means for directing a stream of ions toward such member;

(b) means for providing relative movement between such member and said charging means;

(c) means, located intermediate said charging means and such member, for controlling the passage of ions to the member in accordance with the image pattern thereon; and (d) means for introducing a mist containing of substantially neutrally-charged particles into the space between said controlling means and such member.

9. The invention defined in claim 8 wherein said controlling means comprises slit means and means for electrically-biasing a portion of said slit means to a potential intermediate the image and background portions of the electrostatic image pattern on such member.

10. The invention defined in claim 9 wherein said slit means comprises first and second electrically-conductive layers and an intermediate electrically-insulative layer.

11. The invention defined in claim 10 wherein said second layer faces the image-bearing member and is coupled for electrical bias to said intermediate potential and further including another means for electrically-biasing said first layer to a potential which creates an electrical field enhancing passage through said slit means of ions from said charging means.

* * * * *